US009248335B2

(12) United States Patent
Reyes

(10) Patent No.: US 9,248,335 B2
(45) Date of Patent: Feb. 2, 2016

(54) ROTATING BARBELL SUPPORT STRUCTURE

(75) Inventor: Gil Reyes, Las Vegas, NV (US)

(73) Assignee: GRAA INNOVATIONS, LLC, Las Vegas, NV (US)

( * ) Notice: Subject to any disclaimer, the term of this patent is extended or adjusted under 35 U.S.C. 154(b) by 80 days.

(21) Appl. No.: 13/317,829

(22) Filed: Oct. 27, 2011

(65) Prior Publication Data

US 2012/0225756 A1 Sep. 6, 2012

Related U.S. Application Data

(60) Provisional application No. 61/449,464, filed on Mar. 4, 2011.

(51) Int. Cl.
*A63B 21/078* (2006.01)

(52) U.S. Cl.
CPC ..... *A63B 21/078* (2013.01); *A63B 21/4029* (2015.10)

(58) Field of Classification Search
CPC ..... A63B 21/078; A63B 21/0783; A63B 21/0786; A63B 21/1457; A63B 2021/0783; A63B 2021/0786; A63B 21/4029; A63B 21/072; A63B 21/0724; A63B 21/0726
USPC ..... 482/104, 92–94, 98, 99, 100, 106–108, 482/133
See application file for complete search history.

(56) References Cited

U.S. PATENT DOCUMENTS

| | | | | |
|---|---|---|---|---|
| 4,302,009 | A | 11/1981 | Johnson | |
| 4,602,785 | A * | 7/1986 | Rockwell | 482/104 |
| 4,890,831 | A * | 1/1990 | Craig | 482/104 |
| 5,509,876 | A | 4/1996 | Reyes | |
| 6,447,433 | B1 | 9/2002 | Reyes | |
| 6,450,927 | B1 | 9/2002 | Ellis | |
| 7,226,400 | B1 | 6/2007 | Gedeon-Janvier | |
| 2007/0082795 | A1 * | 4/2007 | Murray et al. | 482/104 |
| 2007/0287598 | A1 * | 12/2007 | Christensen, III | 482/11 |
| 2008/0004165 | A1 | 1/2008 | Brawner | |

OTHER PUBLICATIONS

International Search Report and Written Opinion of the International Searching Authority (PCT/US2011/001452).

* cited by examiner

*Primary Examiner* — Loan H Thanh
*Assistant Examiner* — Nyca T Nguyen
(74) *Attorney, Agent, or Firm* — One LLP

(57) ABSTRACT

A rotating barbell support rotatably holds a barbell in at least a first position and a second position by rotating the barbell between such positions. A user may lie on a bench and rotate the barbell to his or her lifting sweet spot while the rotating barbell support continues to support the weight of the barbell. The user may then begin one or more bench presses from his or her sweet spot without the need to maneuver the full weight of the barbell or the need for a spotter. The rotating barbell support may have a pair of biased support assemblies, each having a support arm and a post. The support arm may have a weight, spring, or elastic element attached thereto, while the post may have a barbell holder. The posts of the support assemblies may be biased to a backward tilted angle by the weight.

5 Claims, 10 Drawing Sheets

ROTATING BARBELL SUPPORT STRUCTURE

Pursuant to 35 U.S.C. §119(e), this patent application hereby references, incorporates by reference, and claims the benefit of U.S. Provisional Application No. 61/449,464, filed Mar. 4, 2011, and naming Gil Reyes as inventor.

BACKGROUND OF THE INVENTION

The invention relates generally to a weight bench, and particularly to a weight bench having a rotating barbell support structure.

The bench press is a widely used weight training exercise that provides highly effective training of the upper body and arms. Typically, a bench press is performed with a user laying with his or her back on a weight bench. A barbell, which may carry one or more weights, may be held above the user on a support. The user may grasp and maneuver the barbell out of the support, and lift the barbell over the user's torso one or more times to perform one or more bench presses.

Maneuvering the barbell out of its supporting structure can be the most hazardous portion of a bench press. In addition, users typically progress from lower weights to higher weights as they strengthen their bodies. As users try to achieve increasing levels of strength and fitness, maneuvering the barbell is increasingly hazardous at the limit of the users' strength.

A spotter is sometimes used to aid the user in maneuvering the barbell. This is undesirable in that it requires the user to have another person on hand when training. In addition, maneuvering the barbell can and is still hazardous to the spotter as well as the user because of the careful coordination and force required to maneuver the barbell out of and back into its supporting structure.

From the discussion that follows, it will become apparent that the present invention addresses the deficiencies associated with the prior art while providing numerous additional advantages and benefits not contemplated or possible with prior art constructions.

SUMMARY OF THE INVENTION

A rotating barbell support is disclosed herein. The rotating barbell support holds the weight of a barbell and any weights attached thereto, while allow a user to easily and safely move the barbell from a storage position to an ideal position above the user. The ideal location or sweet spot may be the position at which the barbell should be located for the user to comfortably and safely perform one or more bench presses. The rotating barbell support does away with the need for a spotter and greatly increases the user's safety since the barbell may be positioned at an ideal position for one or more bench presses.

The rotating barbell support may have various configurations. For example, in one embodiment a rotating barbell support for supporting a barbell at a weight bench may be provided. The rotating barbell support may comprise a first leg member extending upward vertically from a bottom end to a top end, a second leg member extending upward vertically from a bottom end to top end, a first angled support, and a second angled support.

The first angled support may have a weight or a spring at a bottom end and a barbell holder at the top end. The first angled support may also have a bend between the bottom end and the top end to form the angle of the first angled support. Similarly, the second angled support may have a weight at a bottom end and a barbell holder at a top end. The second angled support may also have a bend between the bottom end and the top end to form the angle of the second angled support.

The barbell holder of the first and second angled support may each comprise a concave structure configured to accept at least a portion of a barbell. It is noted that the bottom end and the top end of the first and second angled supports may be generally perpendicular to one another.

A first pivot at the bend of the first angled support may be configured to rotatably mount the first angled support to the first leg member, while a second pivot at the bend of the second angled support may be configured to rotatably mount the second angled support to the second leg member. The first and second angled supports may rotate between a backward tilted position and a forward tilted position about the pivots of the first and second angled supports The rotating barbell support may also include a cross member which connects the first leg member and the second leg member. It is noted that a weight bench may be included and, if so, may be attached to at least the first leg member at the bottom end of the first leg member.

In another embodiment, a weighted support assembly for a rotating barbell support is provided. The weighted support assembly may comprise a support arm and a post. The proximal ends of the support arm and the post may be connected to one another such that the support arm and the post are at a non-parallel angle relative to one another. A weight configured to bias the post to a backward tilted angle may be at a distal end of the support arm. A barbell support may be at a distal end of the post, and be configured to accept a portion of a barbell therein.

A pivot at the proximal end of the support arm may be provided to rotatably mount the weighted support assembly to a leg member of the rotating barbell support. It is noted that the leg member may comprises a horizontal extension. In such embodiments, the pivot may rotatably mount the weighted support assembly to the extension of the leg member.

The support arm may have an open central portion and the leg member may extend through the open central portion. A pad configured to stop forward rotation of the weighted support assembly by coming into contact with the leg member may be at the distal end of the support arm.

Various methods of performing bench presses are also disclosed herein. For instance, in one embodiment a method of performing one or more bench presses using a rotating barbell support is disclosed. The method may comprise lying in a supine position on a bench of a weight bench, and grasping a barbell supported by a plurality of barbell holders. Each of the plurality of barbell holders may be attached to a biased support assembly comprising a support arm and a post. The barbell and the plurality of barbell holders of the biased support assemblies may then be rotated forward from a backward tilted angle to a forward tilted angle. The barbell may be lifted upward from the plurality of upper supports to remove the barbell from the plurality of upper supports and to permit a weight or a spring attached to each of the support arms of the weighted support assemblies to return the weighted support assemblies to the backward tilted angle. Subsequently, the barbell may be raised one or more times to perform the bench presses.

The barbell may be lifted upward from the plurality of barbell supports without moving the barbell laterally in any direction. After training is complete, the barbell may be placed on the plurality of barbell supports while the plurality of posts are at the backward tilted angle.

Rotating the barbell and the plurality of barbell holders of the weighted support assemblies forward may include overcoming a biasing force provided by the weight or the spring attached to the support arms of the weighted support assemblies. The rotation of the weighted support assemblies may be stopped or halted when the barbell is above the user's upper torso.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numbers designate corresponding part throughout the different views.

DETAILED DESCRIPTION OF THE PREFERRED EMBODIMENTS

Figure 1A:
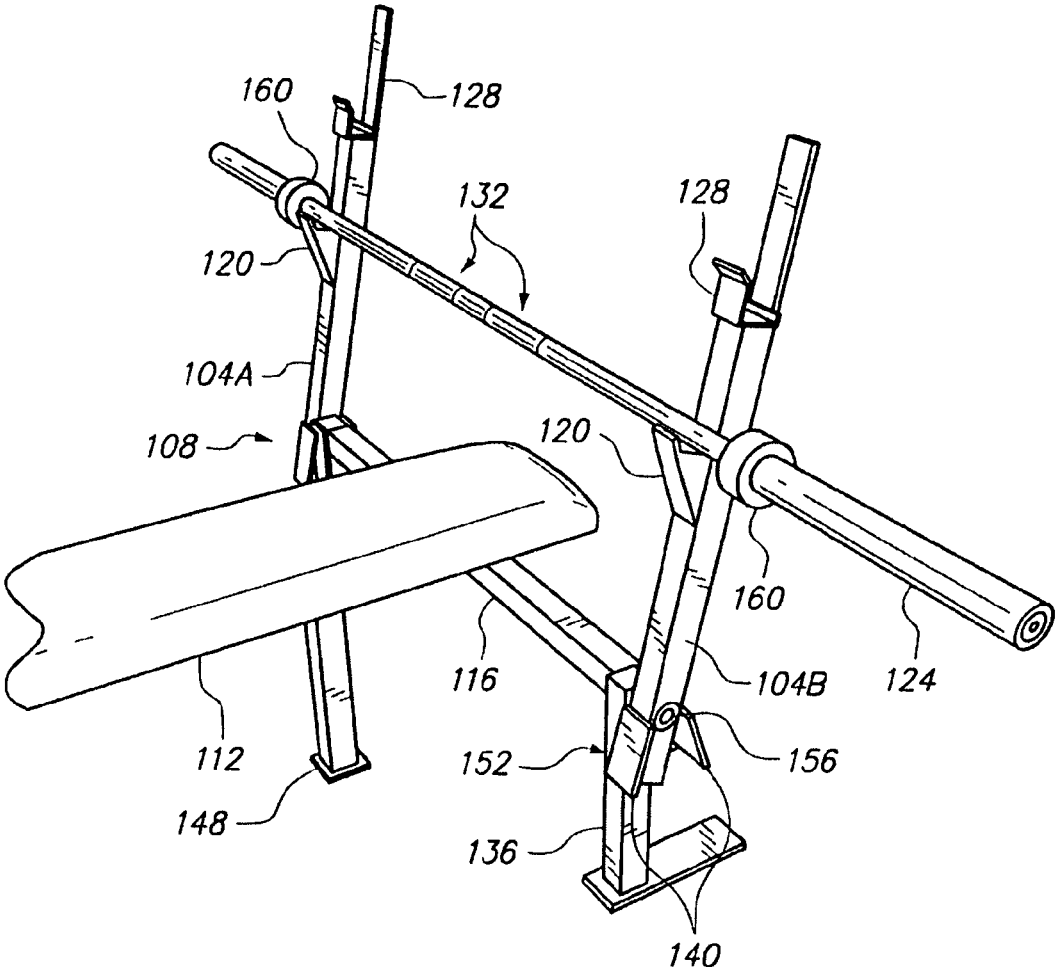
FIG. 1A is a perspective view of an exemplary rotating barbell support.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the rotating barbell support structure supports a barbell that may or may not be laden with one or more weights such that the barbell may be ideally positioned for weight training by a user. The rotating barbell support does not require a spotter and increases the safety of a user while weight training even without a spotter. In addition, since a spotter is not required to lift or maneuver the barbell, the cost and time of the spotter is eliminated, along with potential injuries to the spotter from performing traditional spotting functions.

The rotating barbell support structure is designed to rotate to allow the barbell it supports to be positioned at a user's "sweet spot". This is the area above the user where it is ideal for the user to grasp and lift the barbell during bench presses. This is highly advantageous in that the ideal positioning or sweet spot allows a user to not only achieve efficient weight training but also allow the user to do so while reducing the risk of injury. For instance, maneuvering and lifting a barbell at a position above the user's head may not be ideal for training purposes and may pose a serious risk of injury to the user due to the position of the user's arms in conducting such maneuvers or lifts.

The rotating barbell support will now be described with regard to FIGS. 1A-1B, 7A-7B, and 8. As shown, the rotating barbell support 108 is used with a weight bench 112 which allows users to take advantage of the rotating barbell support's features while performing bench presses. In general, a user may lay with his or her back on the bench 112 to support his or her upper body while one or more bench presses are performed. Typically, the user's upper body is positioned adjacent the rotating barbell support 108 when performing bench presses, as will be described below.

In one or more embodiments, the rotating barbell support 108 may comprise one or more posts 104A, 104B configured to support a barbell 124. The posts 104A, 104B may have various supporting structures to hold a barbell 124. For example, a post 104 may comprise an upper support 128 configured to releasably hold a barbell 124. The upper support 128 may be at a distal end of the post 104, such as shown.

The upper support 128 may have various configurations. In one or more embodiments, the upper support 128 may accept a portion of the barbell 124 to hold the barbell in position. For example, the upper support 128 may have a concave shape or portion, or other shape or portion, which allows a portion of the barbell 124 to be placed and held therein. To illustrate, as shown, the upper support 128 has a "J" shape which allows a portion of the barbell 124 to be placed therein. The concave portion may be sized such to fit the entire diameter or substantially the entire diameter of the barbell 124. In this manner, the upper support 128 may securely hold the barbell 124 even as the rotating barbell support 108 is rotated from one position to another.

The "J" shape of the upper 128 has an enlarged or raised back portion. This is beneficial in that when placing a barbell 124 into the upper support, a user may first contact any portion of the enlarged back portion and allow the barbell to slide into the concave lower portion of the upper support 128.

Other shapes may be used as well. For example, the upper support 128 may be a "U" shape, "G" shape, or "C" shape in some embodiments. Such shapes may be made square to prevent the barbell 124 from rolling out of the upper support 128 when not desired.

As can be seen, the concave portion of the upper support 128 has an open area through which a barbell 124 may be inserted or removed. The shape of the upper support 128 may also comprise a relief or bend which widens the opening of the open area to allow a barbell 124 to be more easily inserted.

A post 104 may also comprise a lower support 120 also configured to releasably support a barbell 124. Typically, the post 104 will have an elongated shape, such as shown. This provides space for a lower support 120 to be attached to the post 104. The lower support 120 is highly advantageous in that it allows a user to place the barbell 124 on the post 104 without having to lift the barbell up to the higher upper support 128. This reduces the risk of minor to serious injury since a user with insufficient strength may relieve him or herself of the barbell's weight without having to lift the barbell 124 all the way up to the upper support 128.

Figure 1B:
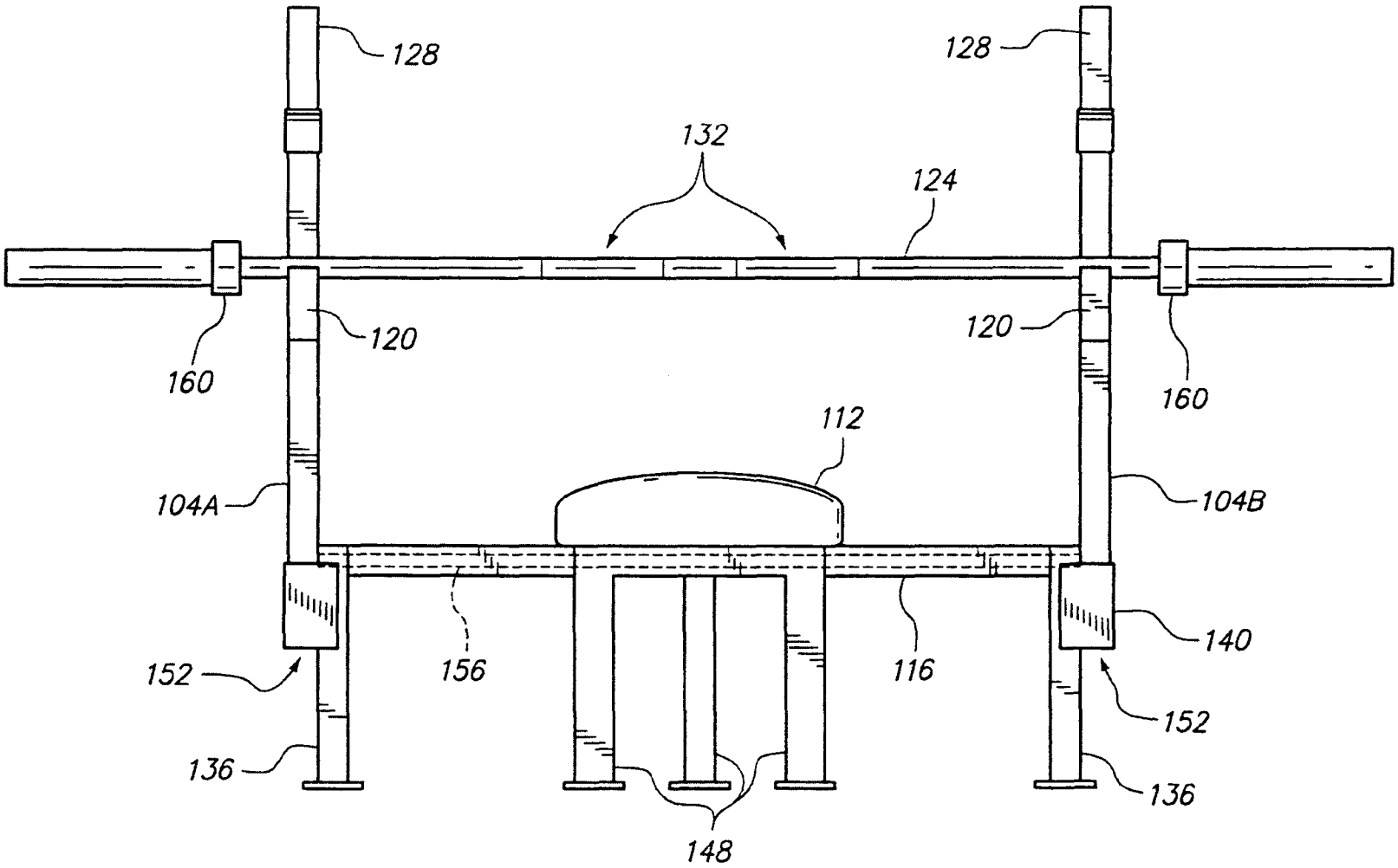
FIG. 1B is a front perspective view of an exemplary rotating barbell support.
Figure 7A:
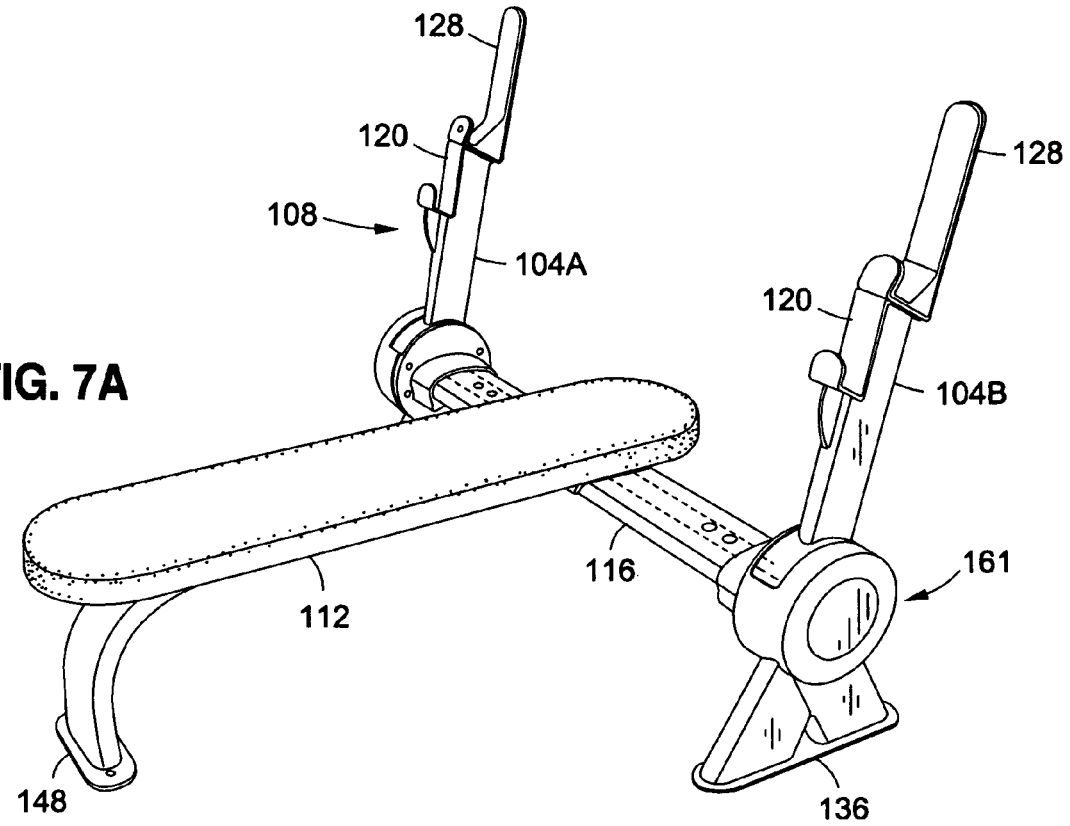
FIG. 7A is a perspective view of an exemplary rotating barbell support.

A lower support 120 may extend from the front of a post 104, such as shown in FIGS. 1A-1B and 7A. In this manner, the lower support 120 may extend toward the user. This is advantageous in that it makes it easier for the user to place a barbell on the lower support 120 (because the distance between the user and the lower support is reduced).

The lower support 120 may have a concave shape to accept a portion of the barbell 124. For example, as shown in FIG. 1A, the lower support 120 can have a shallow "U" shape. Once placed in the lower support 120, the concave shape helps secure the barbell 124 to the post 104. The shallower shape of lower support 120 shown in FIG. 1A allows the barbell 124 (as compared to the upper support 128) to be more easily placed into the lower support 120, while preventing the barbell from rolling out of the lower support 120. For example, in one embodiment, the concave shape of the lower support 120 may be sized such that only half or another portion of the barbell's diameter may fit within the lower support.

The concave shape of the lower support 120 may also or alternatively have a longer horizontal section. This provides an increased surface area upon which a user may rest or place the barbell 124 on the lower support. This is highly beneficial especially in emergency situations where the user desires to relieve him or herself of the weight of the barbell 124. The user need not carefully place the barbell 124 onto the lower support because the increased surface area provides an enlarged area for the user to "aim" the barbell.

Due to the length of a post 104, the lower support 120 may be ideally positioned to relieve the weight of a barbell 124 from a user. To illustrate, as shown, the posts 104A, 104B are angled back in their initial position. However, the lower supports 120 can be positioned closer to the user since they are attached along the length of the posts 104A, 104B. In this manner, the lower supports 120 can be placed closer to the user to more easily place a barbell 124 onto the lower supports 120. For instance, as can be seen, attaching the lower supports 120 between the ends of the posts 104A, 104B positions the lower supports closer to the user in the horizontal direction than the upper supports 128.

Locating a lower support 120 between the ends of a post 104 also allows a portion of the post to provide a surface area where a barbell 124 may be slid into or onto the lower support 120. For example, a user may first contact a portion of the post 104 above the lower support 120 with the barbell 124 and then allow the barbell to slide or drop into the lower support. The backward angle and length of the post 104, when in an initial or unrotated position, helps guide the barbell 124 into the lower support 120 reducing the risk that the barbell misses the lower support as the barbell drops or slides downward. This is highly beneficial especially in an emergency situation since the user need not carefully place the barbell 124 into the lower support 120. Instead, the user need only move the barbell 124 to the posts 104A, 104B and allow the barbell to slide or drop naturally into the lower support, relieving the user of the barbell's weight quickly and easily.

The posts 104A, 104B may be spaced apart to support various sections of a barbell 124. For instance, as shown the rotating barbell support 108 comprises two posts 104A, 104B that are spaced apart to hold a barbell 124 at both sides of the barbell. The spacing of the posts 104A, 104B may be achieved in various ways. In the embodiment shown for example, a cross member 116 defines the distance between the posts 104A, 104B. The distance between the posts 104A, 104B may be changed by lengthening or shortening the cross member 116.

In general, the spacing between posts 104A, 104B will be such that a user may grasp the barbell 124 with both hands between the posts 104A, 104B, such as at grasping points 132 (i.e., spaced apart wider than a user's shoulders). Alternatively, or in addition, the posts 104A, 104B may be spaced apart to accommodate particular barbells 124. For instance, as shown in FIGS. 1A-1B in particular, the posts 104A, 104B are between the stops 160 of the barbell 124 which help secure any weights placed on the barbell at the ends of the barbell.

Figure 7B:
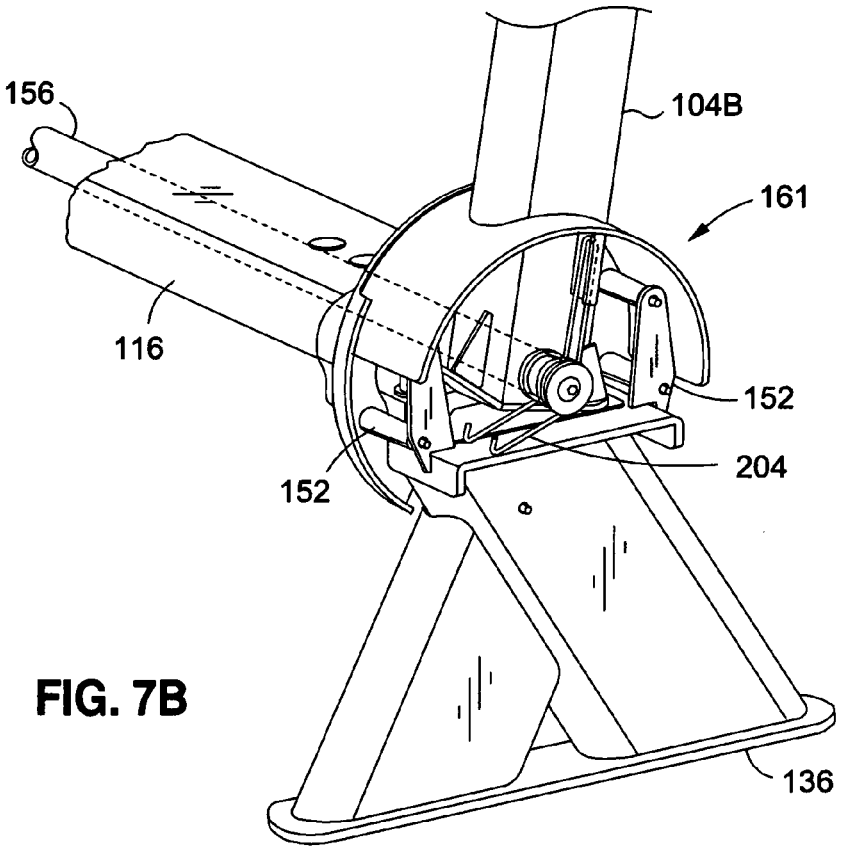
FIG. 7B is a perspective view showing detail of a portion of an exemplary rotating barbell support.

Referring to FIGS. 1B and 7B, the posts 104A, 104B may be connected by an axle 156 in one or more embodiments. In this manner, the posts 104A, 104B may rotate in unison, as will be described further below. This is highly advantageous in that the upper support 128 and lower support 120 of both the first post 104A and the second post 104B are aligned at the left and right sides of the user. Since the barbell 124 is typically a straight bar, this allows a user to easily place the barbell 124 on either the upper support 128 or the lower support of the first post 104A and the second post 104B. Also, the rotation of the posts 104A, 104B in unison causes the barbell 124 to be positioned perpendicular to the user even if only one of the posts or one side of the barbell 124 is being moved. This allows the barbell 124 to be ideally placed, such as perpendicular to the user's body, as the rotating barbell support 108 is rotated from one position to another.

The axle 156 may be an elongated member which extends from a first post 104A to a second post 104B. The axle 156 may be positioned within a cross member 116 such as shown in FIGS. 1B and 7A-7B. The axle 156 may be held by a rotating mount or support, such as a bearing or bushing mount, to allow the axle to rotate. For example, in the embodiment shown in FIG. 8, bearing 162 surrounds a portion of the axle 156 and permits the axle to rotate therein. The rotating support may also be a pivoting structure, such as a hinge or the like. This allows the posts 104A, 104B to rotate as well. The axle 156 may have a circular cross sectional shape or various portions of the axle may have a circular cross sectional shape to allow such rotation. In some embodiments, the axle 156 may have an irregular shape, such as an oval or oblong shape. These shapes allow the axle 156 to rotate unevenly thus allow the upper supports 128 and lower supports 120 to rotate about a non-circular arc. This is beneficial in that such an arc may position the upper supports 128 and/or lower supports 120 differently than a circular arc, allowing the rotating barbell support 108 to be customized for particular applications and/or users.

In the embodiment shown in FIGS. 1A-1B and 7A, the axle 156 extends a distance within the cross member 116 such that the posts 104A, 104B are located at the ends of the cross member. In this manner, the posts 104A, 104B rotate at the ends of the cross member 116. It is contemplated that the axle of 156 may be longer than the cross member 116 in some embodiments. For example, the axle 156 may extend past the ends of the cross member 116. In such embodiments, the length of the axle 156 may define the spacing between the posts 104A, 104B.

It is contemplated that an axle 156 need not be used in all embodiments. For example, the posts 104A, 104B may be mounted to a pivot or rotating mount at the ends of a cross member 116 in some embodiments. The posts 104A, 104B may be connected by another cross member to cause the posts 104A, 104B to rotate in unison.

The posts 104A, 104B may be elevated off the ground or floor in one or more embodiments. For example, as shown in FIGS. 1A-1B and 7A, the posts 104A, 104B are supported above the floor by legs 136. Various other structures could be used. For example, a base, frame, pedestal, or the like may elevate the posts 104A, 104B. Alternatively or in addition, the posts 104A, 104B may be supported at particular elevation by being connected to a bench 112, its legs 148, or other portions of a weight bench.

In one or more embodiments, the posts 104A, 104B may be elevated via the cross member 116. For example, legs 136, a frame, a base, or other elevating structures could elevate the posts 104A, 104B by being attached such that the elevating structures raise the cross member 116 such as shown. Alternatively, legs 148 or other elevating structures could elevate the posts 104A, 104B by elevating the axle 156. It is contemplated that a cross member 116 need not be provided in such embodiments. For example, the axle 156 may support the posts 104A, 104B without need for a cross member 116. The axle 156 itself may be elevated/supported by rotating mounts attached to legs 148 or other elevating structures in such embodiments.

As shown in FIGS. 1A-1B and 7A, the legs 136, base, frame, or other elevating structure may be relatively low to the ground. In one or more embodiments for example, the elevating structure may be shorter than or equal in height of the bench 112. The remaining portion of the rotating barbell support 108 may be formed by the posts 104A, 104B which extend from the legs 136, base, frame, or other elevating structure to the top of the rotating barbell support 108 where one or more upper supports 128 may be attached. In this manner, the majority of the height of the rotating barbell support may be formed by its posts 104A, 104B. This provides adequate space for the posts 104A, 104B to support the lower supports 120 between the proximal and distal ends of the posts (i.e., below the upper supports).

Figure 8:
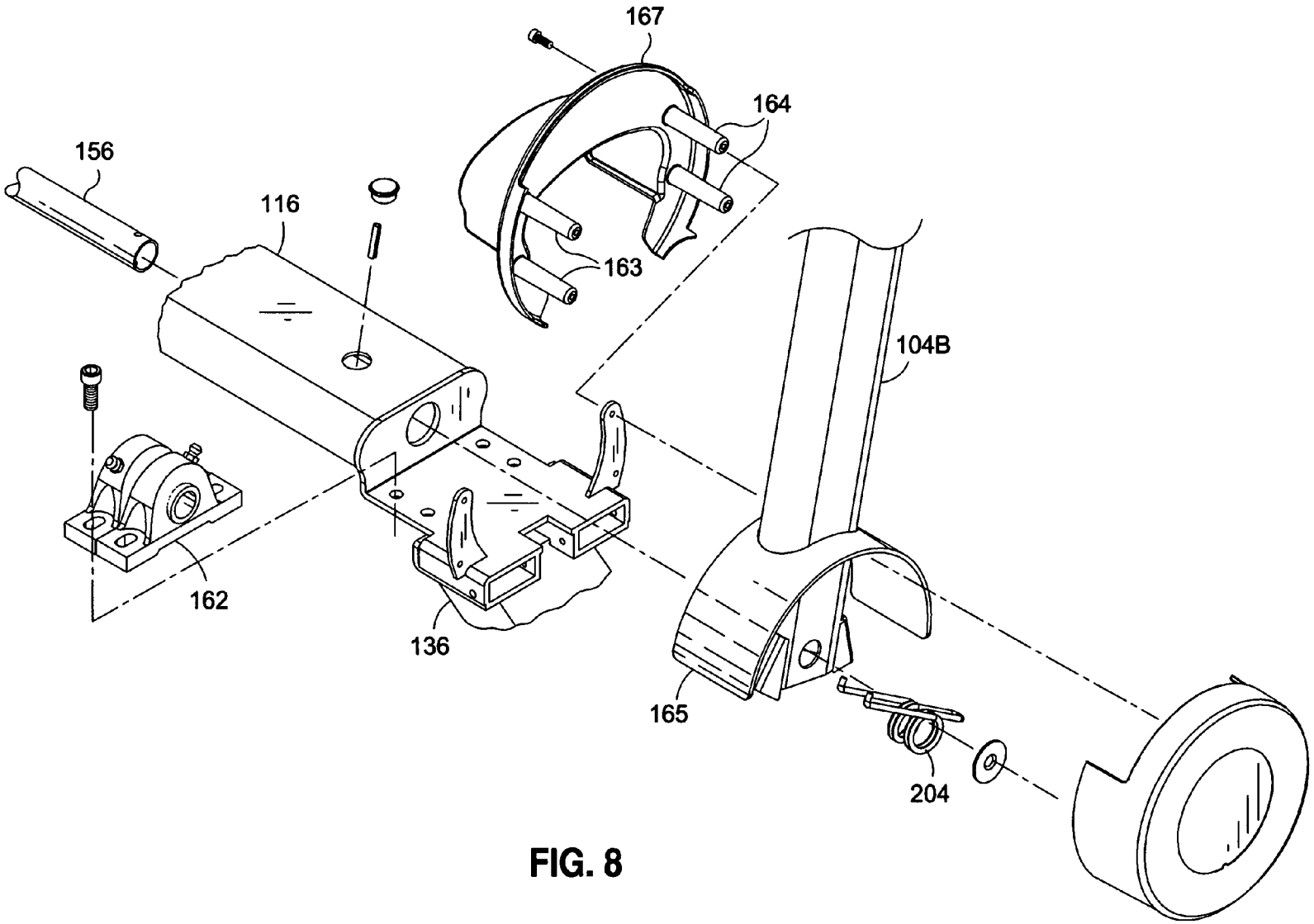
FIG. 8 is an exploded view showing detail of a portion of an exemplary rotating barbell support.

In the device shown in FIGS. 7-9, the lower ends of posts 104A, 104B are engaged with a cover 165 that moves with posts 104A, 104B within a housing comprised of an outer-side housing 4-66 and an inner-side housing 167, as showing in FIG. 8.

Figure 2C:
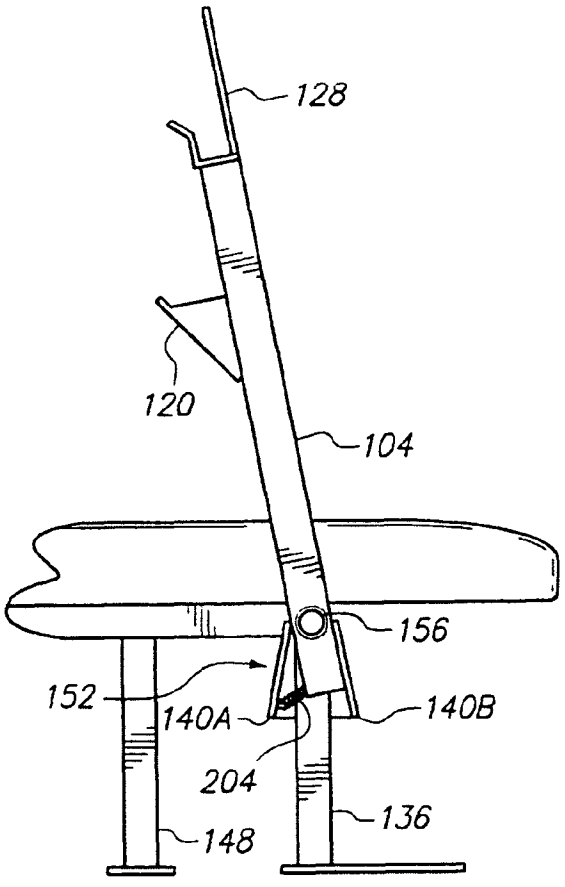
FIG. 2C is a side view of an exemplary rotating barbell support in a forward tilting position.
Figure 2B:
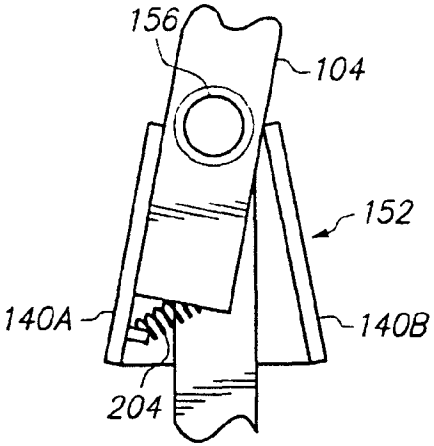
FIG. 2B is a side view of an exemplary stop and rotating barbell support in a backward tilting position.
Figure 2D:
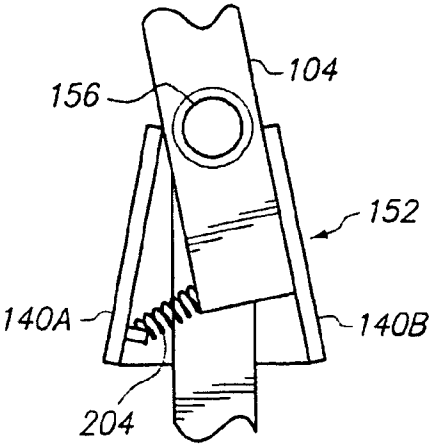
FIG. 2D is a side view of an exemplary stop and rotating barbell support in a forward tilting position.
Figure 2A:
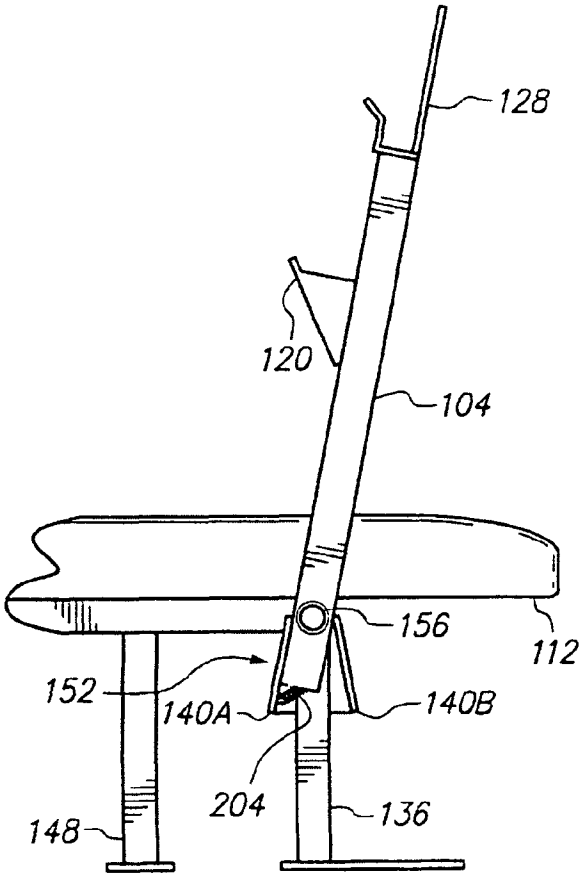
FIG. 2A is a side view of an exemplary rotating barbell support in a backward tilted position.
Figure 9A:
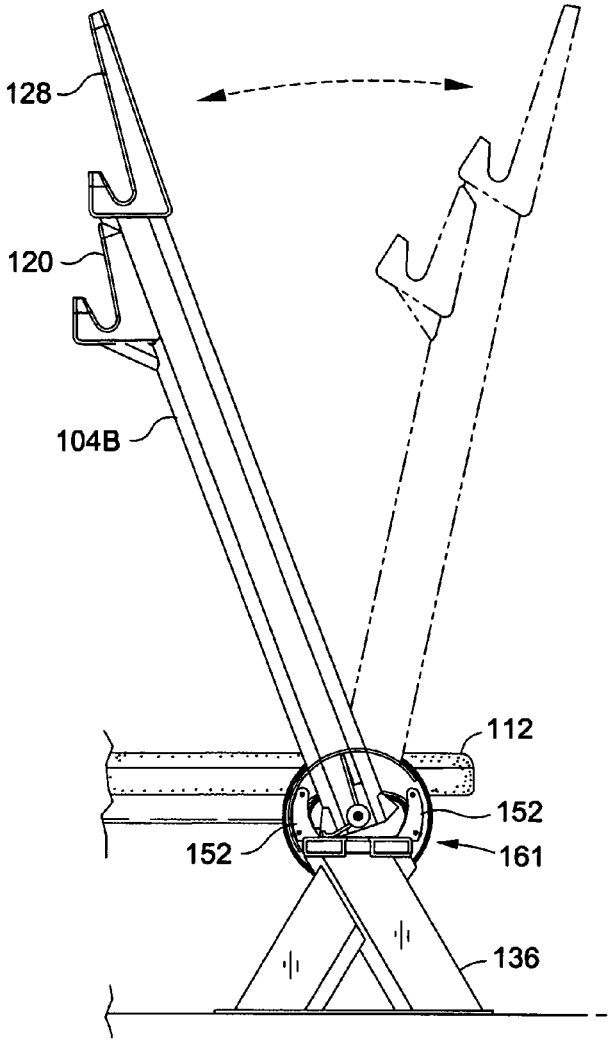
FIG. 9A is a side view of an exemplary rotating barbell support in a forward tilting position.
Figure 9B:
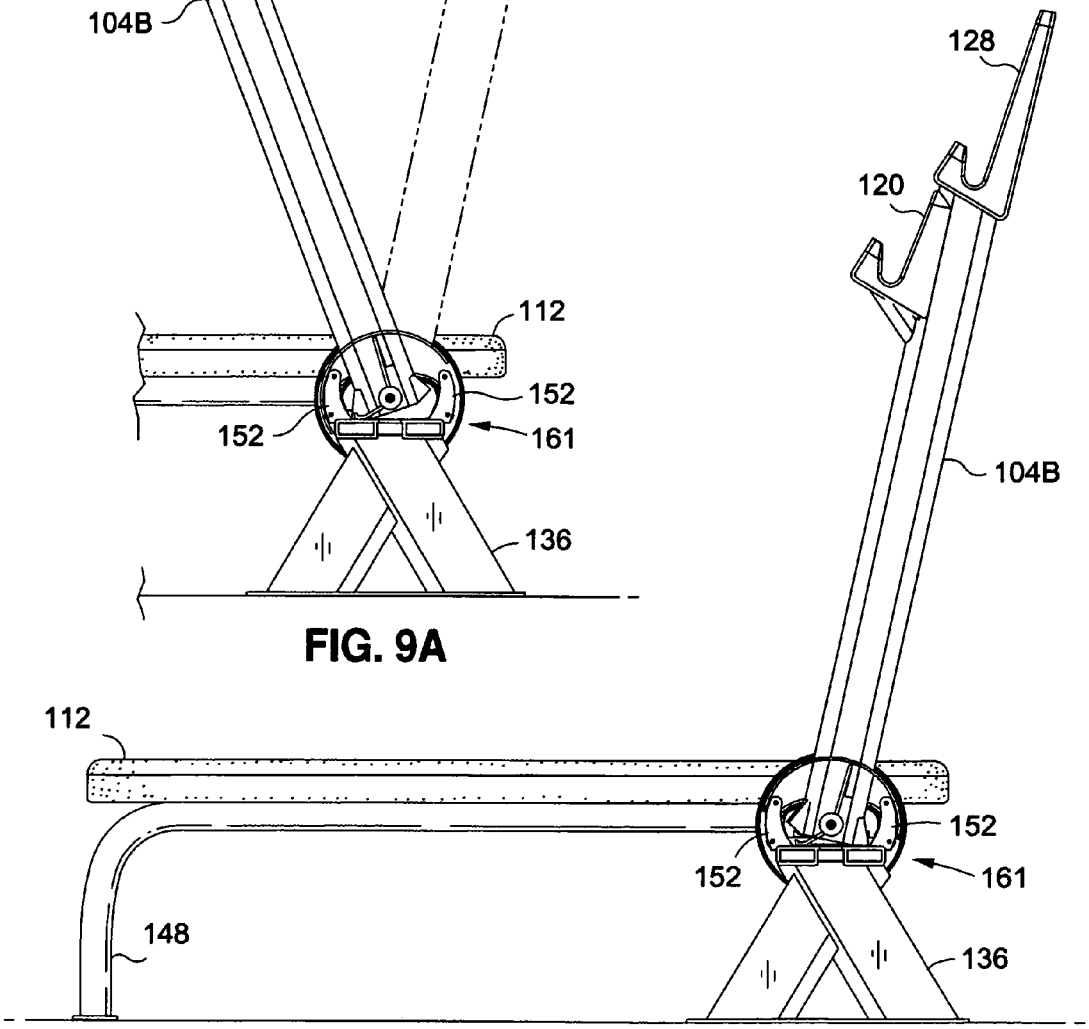
FIG. 9B is a side view of an exemplary rotating barbell support in a backward tilted position.

FIGS. 2A-2D and 9A-9B illustrate rotation of an exemplary rotating barbell support 108. FIGS. 2A-2B show the rotating barbell support 108 in a backward tilted position or reclined position, and FIGS. 2C-2D show the rotating barbell support in a forward tilted position. FIG. 9A shows the rotating barbell support 108 in a forward tilted position, and FIG. 9B shows the rotating barbell support 108 in a backward tilted position. As can be seen in FIGS. 2A-2D and 9A-9B, the rotating barbell support 108 may move or rotate while supporting a barbell 124. This allows a user to easily position the barbell 124 at an ideal location for bench presses or sweet spot, while the rotating barbell support 108 holds the weight of the barbell 124 (and any weights thereon).

In the backward tilted position, the posts 104A, 104B of the rotating barbell support 108 may be angled backwards such as shown in FIGS. 2A-2B and 9B. The barbell 124 may be stored in this position when not in use. The backward angle of the posts 104A, 104B can utilize the weight of the barbell 124 to keep the posts 104A, 104B in the first position. In this manner, the risk of the posts 104A, 104B rotating forward when no desired is reduced if not eliminated.

In the forward tilted position, the posts 104A, 104B of the rotating barbell support 108 may be angled forward, such as shown in FIGS. 2C-2D and 9A. This is advantageous as well. For instance, the forward angle of the posts 104A, 104B positions the barbell 124 at a user's sweet spot above the user's upper torso, such as above the user's shoulders or pectoral muscle area. In this manner, one or more bench presses may be performed starting from the user's sweet spot. It is noted that this feat is accomplished by the rotating barbell support 108 without the need for a spotter.

The angle of the posts 104A, 104B in the first and second position may be defined by one or more stops 152 which limit the rotation of the posts. In general, the stops 152 are physical structures which block or prevent rotation of the posts past a particular angle. For instance, the stop 152 shown in FIGS. 1A-1B and 2A-2B comprises a first plate 140A and a second plate 140B. The first plate 140A defines the angle of the posts 104A, 104B in the first position, while the second plate 140B defines the angle of the posts in the second position. This is accomplished by stopping the rotation of the posts 104A, 104B at a particular location.

As can be seen from FIGS. 2A-2B, in the first position, the posts 104A, 104B contact the first plate 140A. Likewise, as shown in FIGS. 2C-2D, the posts 104A, 104B contact the second plate 140B when in the second position, as shown in FIGS. 2C-2D. By contacting the first and second plates 140A, 140B of the stop 152 in this manner, the rotation or movement of the posts 140A, 104B is limited. As can be seen, the posts 104A, 104B may move between the first position and the second position but not beyond the first position and second position.

In the embodiments shown, the first plate 140A and second plate 140B are themselves angled to correspond to the angles of the first position and second position. Referring to FIG. 2B for example, it can be seen that the angle of the post 104 matches that of the first plate 140A when in the first position. Referring to FIG. 2D, it can be seen that the angle of the post 104 matches that of the second plate 140B when in the second position.

It is contemplated that a stop 152 need nor comprise plates because other structures may be used to block or restrict movement of the posts 104A, 104B. For example, a stop 152 may comprise one or more pegs, pins extensions, or protrusions which are located to stop the posts 104A, 104B at the first position and the second position. Such an embodiment is shown in FIGS. 7A-7B and 8, wherein stop 152 comprises horizontal pegs, a front pair of horizontal pegs 163, and a rear pair of horizontal pegs 164, which block or limit movement of the posts 104A, 104B. Alternatively, it is contemplated that the rotation of the axle 156 which rotatably supports the posts 104A, 104B may be limited by one or more stops.

In one or more embodiments, the posts 104A, 104B may be biased towards the first position. In this manner, the posts 104A, 104B will automatically return to the first position unless otherwise manipulated or moved. Referring to FIGS. 2B and 2D, as well as FIGS. 7B and 8, for example, a spring 204 may be used to bias the posts 104A, 104B. Other structures and devices also may be used to bias posts 104A, 104B, including other elastic devices or structures known to persons of skill in the art, such as weights, counterweights, or other biasing devices or structures, including any other type of spring known to persons of skill, including torsion springs, flat springs, and the like. One end of the spring 204 may be attached to a post 104 while the other end is attached to the stop 152, such as the first plate 140A, as shown in FIGS. 2B and 2D. In this configuration, the spring 204 would pull the post 104 toward the first plate 140A thus biasing/pulling the post 104 to the first position. As can be seen in FIG. 2D, when the post 104 is moved away from the first position, the spring 204 is stretched causing it to exert a force that pulls the post 104 back toward the first plate 140A and the first position. Referring to FIGS. 7B and 8, spring 204 is a torsion spring, wherein one side of spring 204 is engaged with post 104B, and the other side of spring 204 is engaged with the support structure of the assembly.

Such biasing of the posts 104A, 104B is advantageous because it moves the posts out of the user's way once the barbell 124 is removed. In this manner, one or more bench presses may be performed by the user without the posts 104A, 104B hindering movement of the barbell 124 or otherwise being in the user's way. In effect, the biasing clears the posts 104A, 104B out of the users way when the user desires to perform one or more bench presses. The biasing also holds a barbell 124 securely at the first position when not in use.

Figure 3A:
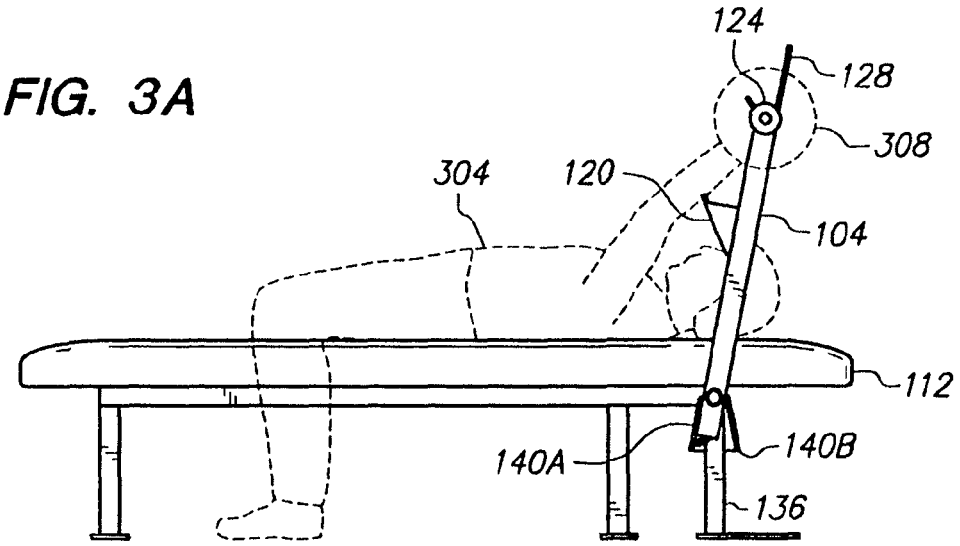
FIG. 3A is a side view illustrating operation of an exemplary rotating barbell support holding a barbell in a backward tilted position.
Figure 3B:
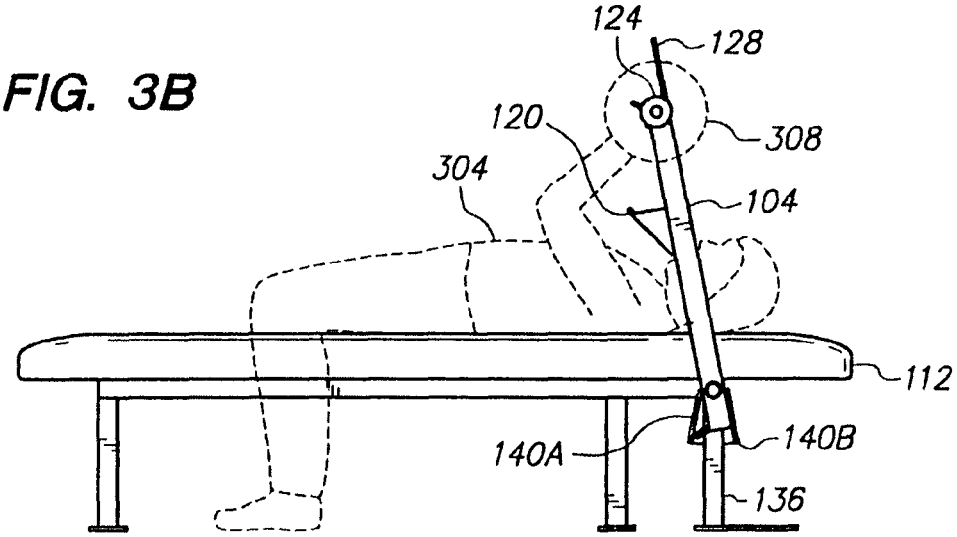
FIG. 3B is a side view illustrating operation of an exemplary rotating barbell support holding a barbell in a forward tilted position.
Figure 3C:
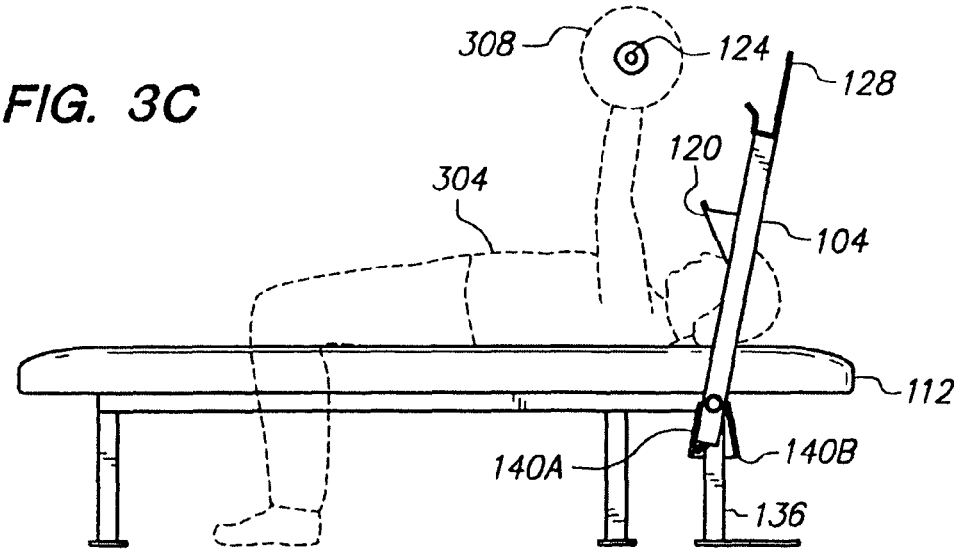
FIG. 3C is a side view illustrating operation of an exemplary rotating barbell support in a backward tilted position.

Operation of the rotating barbell support 108 will now be described with regard to FIGS. 3A-3C. The device shown in FIGS. 7-9 operates in the same or similar manner as is described here with respect to FIGS. 3A-3C. In general, FIGS. 3A-3C illustrate a user 304 utilizing the rotating barbell support 108 during weight training. As can be seen, no spotter or other assistant is required to position the barbell 124 for the user. Referring to FIG. 3A, it can be seen that a user may lie on a bench face-up or in a supine position to perform one or more bench presses. The user 304 may then grasp a barbell 124 supported by the rotating barbell support 108. As discussed above, the barbell 124 may be held or secured by an upper support 128 of the rotating barbell support's posts 104. The user 304 may grasp the barbell 124 when the posts 104 are in a reclined or backward tilted angle. As can be seen, the user 304 may do so by reaching his or her hands upward and back towards the barbell 124.

Once grasped, the user 304 may move the barbell 124 to his or her sweet spot for performing one or more bench presses. This may be accomplished by rotating the posts 104 forward, such as shown in FIG. 3B. For example, the user 304 may pull the barbell 124 forward towards the user's upper torso. This in turn causes the posts 104 to rotate towards the user's torso. As can be seen, the barbell 124 remains supported by the posts 104 as the post rotate. Since the posts 104 may be connected by an axle or the like to rotate in unison, moving or rotating one of the posts 104 causes both posts to rotate. The upper supports 128 and the lower supports 120 attached to the posts 140 are rotated and move with the posts, as can be seen.

In FIG. 3B it can be seen that the user 304 has successfully located the barbell 124 over his or her sweet spot. The weight of the barbell 124 and any weights 308 on the barbell are supported by the rotating barbell support 108. Thus, it can be seen that the user 304 has safely and easily moved the barbell 124 with weights 304 from a stored position to his or her sweet spot. This has been accomplished without the use of a spotter and without requiring the user 304 to exert the considerable force that would be required to otherwise move the barbell 124 from a stored position to a position where one or more bench presses may be safely and properly performed. With the rotating barbell support 108 the user may move the barbell 124 from a stored position to his or her sweet spot with minimal effort and reduced or no risk to safety.

As shown in FIG. 3B, the user's arms may extend substantially perpendicular to the user's body to grasp the barbell 124 when the barbell is positioned at the user's sweet spot by the posts 104. The user 304 may then move the barbell 124 out of the upper supports 128. For example, the user 304 may lift the barbell 124 slightly to remove the barbell from a concave position of the upper supports 128.

Once the barbells 124 are "freed" from the upper supports 128, a spring 204 or a biasing mechanism of the rotating barbell support 108 may cause the posts 104 to automatically rotate backward to the backward tilted angle, such as shown in FIGS. 3C and 9A-9B. In this manner, the posts 104 are moved out of the way of the user 304 so that one or more bench presses may be performed without hindrance. As can be seen from FIG. 3C for example, the posts 104 have rotated away from the barbell 124 and weights 308 providing a free space in which the user 304 may lift the barbell and weights to perform one or more bench presses.

The benefit of positioning the barbell 124 at the user's sweet spot can be seen from FIGS. 3B-3C. Namely, it can be seen that a user 304 may immediately begin one or more bench presses. In fact, the first bench press may begin in a single continuous motion starting with the upward lifting of the barbell 124 from the upper supports 128. Unlike traditional devices, the user 304 need not maneuver the barbell 124 in any lateral direction (e.g., forwards, backwards, or sideways) when using the rotating barbell support 108. Instead, the user may simply lift upward to both release/remove the barbell 124 from the upper supports 128 and to begin the lifting phase of a bench press. As can also be seen from FIGS. 3B and 9A, the forward tilting angle of the posts 104 allows this to occur. Again, this is inconvenient and poses a strong risk of injury especially where the barbell carries a significant amount of weight.

As can also be seen from FIGS. 3C and 9A-9B, the lower supports 120 remain relatively close to the user 304 in case the user needs to relieve the weight of the barbell 124 onto the lower supports. To illustrate, as shown, the lower supports 120 are lower and closer to the user 304 than the upper supports 128 due in part because of the backward tilting angle of the posts 104 when in the backward tilting position. The length of the posts 104, which extend from the legs, base, frame, or other elevating structure of the rotating barbell support 108, allows the lower supports 120 to be positioned in this manner.

Once the user 304 has performed a desired number of bench presses, the barbell 124 may be returned to the rotating barbell support 108. Typically, this would occur by placing the barbell 124 onto the posts 104, such as on one or more lower supports 120 or one or more upper supports 128. Where the user lacks sufficient strength or energy to place the barbell 124 into the upper supports 128, the user may more easily place the barbell into the lower supports 120. As stated, the posts 104 of the rotating barbell support position the lower supports 120 closer to the user than the upper supports 128 even when the posts are at the backward tilting angle.

It is contemplated that a mechanical or motorized return mechanism may be included in one or more embodiments. In general, such a return mechanism may be configured to automatically move or rotate the posts 104 forward to the forward tilted angle. The return mechanism may be configured to rotate the posts 104 in this manner when triggered or activated by the user. For example, a switch, button, or the like may be used to cause the return mechanism to rotate the posts 104 forward.

This is advantageous in that the upper supports 128 and/or lower supports 120 can then be moved closer to the user allowing the user to place the barbell 124 on the upper supports or lower supports with little or no lateral maneuvering of the barbell. This increases the user's safety and the convenience of the rotating barbell support 108. The switch, button, or other trigger may be actuated by the user. The trigger may be positioned such that the user may activate the trigger even while holding the barbell 124. For example, a hand switch may be on the barbell 124, on a glove or strap worn by the user. Alternatively, a foot or leg switch may be activated by one or more of the user's feet. Once activated, the trigger may cause a motor to rotate the posts 104 forward, or may cause a weight coupled to the posts to be released which pulls or pushes the posts forward.

Figure 4:
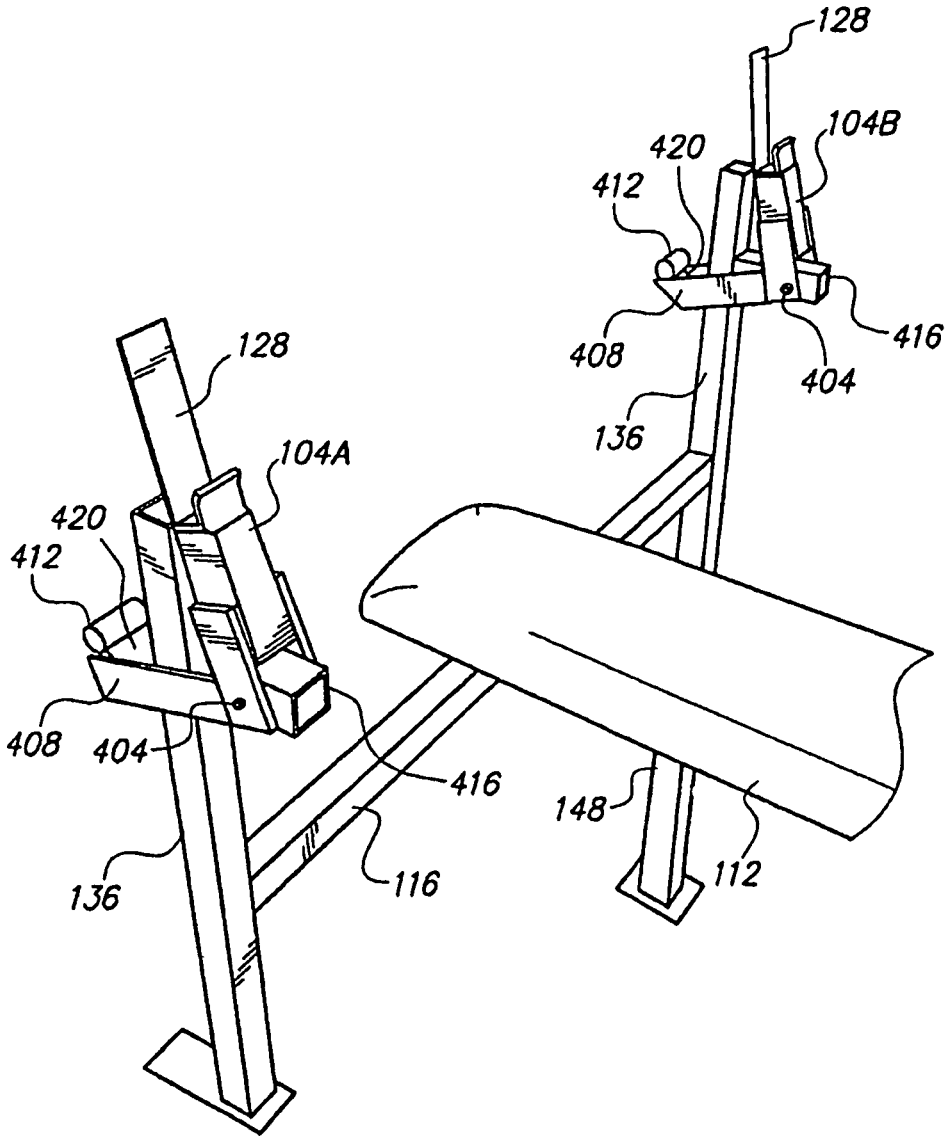
FIG. 4 is a perspective view of an exemplary rotating barbell support.

FIG. 4 illustrates another embodiment of a rotating barbell support having a weighted arm assembly that is configured to return a barbell to a backward tilted position. The weighted arm assembly may comprise an angled structure, such as the "L" shaped structure illustrated having a top end and a bottom end. The top end may be formed by a post 104A, while the bottom end may be formed by a support arm 408. A bend between the ends of the angled support structure may provide the angled or "L" shaped configuration of the angled support structure.

As can be seen, the post 104A may extend generally upward to support an upper support 128. A support arm 408 may extend from a proximal end of the post 104A at various angles, such as the generally 90 degree angle shown. In general, the support arm 408 is configured to secure a weight 412 to the weighted arm assembly.

A weighted arm assembly may be supported by a leg 136 of the rotating barbell support. The leg 136 may extend a distance above a user (that is lying on the bench 112) to hold the weighted arm assembly above the user. Alternatively or in addition, the weighted arm assembly may comprise a post 104A that extends such that its upper support 128 is above the user.

As can be seen the leg 136 may have one or more extensions to support the weighted arm assembly. For example, as shown, the leg 136 comprises an extension 416 extending generally perpendicular from the arm. Another portion of the leg 136 may continue upward behind the post 104A such as to form a backstop for the post. In this manner, the post 104A may be prevented from rotating backward past a particular point. The height of the leg 136 behind the post 104A (i.e., the backstop) may be raised or lowered to change the distance the post 104A may rotate backward. In general, the backstop will be configured to provide a physical structure which stops the post 104A at the backwards tilting angle sufficient to hold the barbell in position. Typically, this will be an angle greater than 90 degrees relative to the extension 416, such as illustrated.

One or more pivots 404 may be provided to allow the weighted arm assembly to rotate from a backward tilted position to a forward tilted position. In one or more embodiments, a pivot 404 may be at or near the junction between the post 104A and the support arm 408. In other words, the pivot 404 may be at or near the proximal ends of the post 104A and the support arm 408.

One section or portion of a pivot 404 may attach to the weighted arm assembly while another portion attaches to a section of the leg 136, such as the extension 416 of the arm. The pivot 404 may comprise an axle to allow rotation in some embodiments. For example, in addition to the pivot 404 shown, the pivot may be a hinge or other rotating mount. It is noted that the weighted arm assembly need not be pivotably mounted to an extension 416 and may be mounted directly to the main member of an leg 136. In such embodiments, a separate backstop or other stop may be mounted to the leg 136 to stop the post 104A at a particular backward tilting angle.

In one or more embodiments, the support arm 416 may be hollow or have an open central portion to allow it and the post 104A to rotate around the leg 136 and/or extension 416. For example, as shown, the support arm 416 has an open middle section within which the leg 136 and extension 416 may be located. This allows the post 104A to come into contact with the leg 136 when rotated, thus allowing the leg to function as a backstop. As will be described further below, this also allows the leg 136 to function as a forward stop that prevents the post 104A from rotating forward past a particular point in one or more embodiments.

As can be seen, the rotating barbell support may comprise two or more weighted support assemblies. Typically these will be positioned at opposite ends of a barbell. A first weighted assembly may be at a left side of the barbell while another weighted support assembly may be at the right side of the barbell for example. In this manner, the posts 104A, 104B and their attached upper supports 128 may support a barbell. The weighted support assemblies may pivot independently of one another. Alternatively, though not shown, a connecting rod or member may be between and connect the assemblies such that they rotate in unison. It is noted that a barbell may function as a removable connecting rod, and/or a fixed connecting rod may be attached to the assemblies.

Figure 5A:
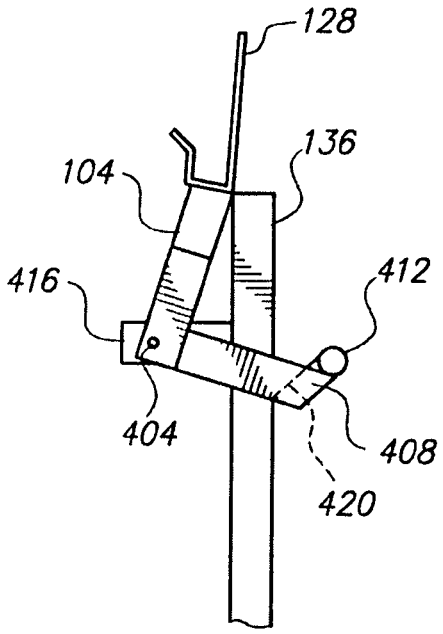
FIG. 5A is a side view of an exemplary weighted arm and rotating barbell support in a backward tilting position.
Figure 5B:
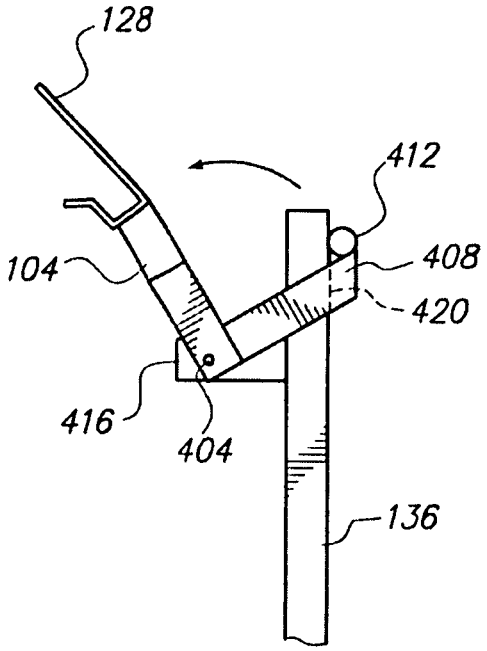
FIG. 5B is a side view of an exemplary weighted arm and rotating barbell support in a forward tilting position.

Operation of the weighted support assembly will now be described with regard to FIGS. 5A-5B. FIG. 5A illustrates the weighted support assembly in a backward tilting position, while FIG. 5B illustrates the weighted support assembly in a forward tilting position. Referring to FIG. 5A it can be seen that the Weight 412 helps pull the post 104 to a backward tilted position. The backward rotation of the weighted support assembly may be halted when the post 104, upper support 128, or other portion of the weighted support assembly comes into contact with a backstop or other stop, such as the leg 136. As can be seen the angle at which the post 104 stops is such that a barbell is not easily inadvertently rotated forward since the user would have to overcome both the weight of the barbell and the weight of the weight 412. This helps prevent accidental forward rotation of the weighted support assembly which would be highly undesirable.

As can be seen in FIG. 5A, a mating pad or structure 420 may be provided. In the backward tilted position, the mating pad 420 may be away from a stop of the rotating barbell support. For instance, as shown, the mating pad 420 is remote from the leg 136 in the backward tilted position of FIG. 5A.

Referring to FIG. 5B, it can be seen that a user may rotate the weighted support assembly to a forward rotated position. This positions the barbell at an ideal location for bench presses (i.e., the user's sweet spot). As can be seen, as the post 104 and upper support 128 are rotated forward, the support arm 408 rotates as well. The open area of the support arm 408 allows the support arm to move while a first side and second side of the support arm surround the leg 136.

As stated above, forward rotation of the weighted support assembly may be stopped by physical contact with the leg 136 or other structure of the rotating barbell support. For instance, the weight 416 or a portion of the support arm 408 may contact the leg 136 and stop rotation. Alternatively, if a mating surface or pad 420 is provided, the forward rotation may be stopped when such structure comes into contact with a portion of the rotating barbell support, such as the leg 136. The mating structure 420 may be oriented or angled such that it comes into flush contact with the leg 136 in one or more embodiments. For instance, the mating pad 420 may be angled such that it has the same angle as the leg 136 when the weighted support assembly is rotated to a forward tilted position. This is beneficial in that it helps ensure that the post 104 and the upper support 128, and thus a barbell, is held stable when in the forward position. The mating pad 420 also expands the contact surface between the leg 136 and weighted support assembly so as to reduce wear and tear, in addition to holding a barbell stable when in a forward tilted position.

It is noted that the weighted support assembly may be configured such that, once in the forward tilted position, it remains in the forward tilted position unless force is applied to return the assembly to a non-forward tilted position. This may be accomplished by adjusting the location of the pad 420 such that gravity may hold the weighted support assembly in the forward tilted position once that position is reached. This is advantageous in that it allows a user to position a barbell over his or her sweet spot and take a moment (or more) to prepare for one or more bench presses without having to hold the barbell in the sweet spot position.

The performance of one or more bench presses utilizing a rotating barbell support configured with a weighted support assembly will now be described with regard to FIGS. 6A-6C. Similar to FIGS. 3A-3C, it can be seen that the weighted support assembly embodiment also holds the user's barbell 124 at the user's sweet spot. In addition, the upper supports 128 continue to allow the user to easily remove and replace a barbell 124, even one laden with heavy weights 128. More specifically, the upper supports 128 of the weighted support assembly allow a user 304 to lift a barbell 124 upward as though performing a bench press. This does away with the traditional need to manipulate the barbell 124 before performing a bench press. In addition, this greatly increases the user's safety and reduces, if not eliminates, the need for a spotter such as described above.

Figure 6A:
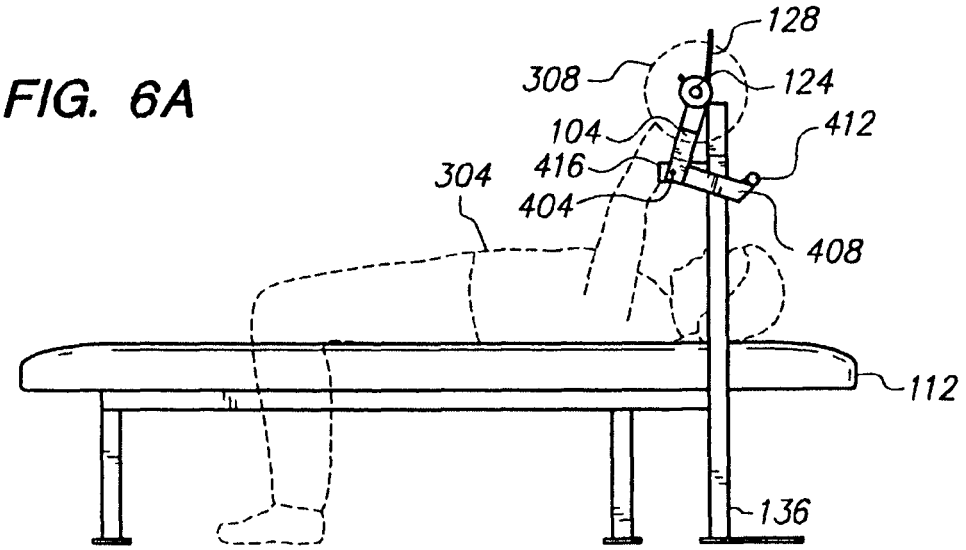
FIG. 6A is a side view illustrating operation of an exemplary rotating barbell support holding a barbell in a backward tilted position.

Referring to FIG. 6A, it can be seen that a user 304 may grasp a barbell 124 while the barbell is held by one or more weighted support assemblies in a backward tilted position. As can be seen, the barbell 124 may be held by upper supports 128 of the weighted support assemblies. In one or more embodiments, the user 304 may reach upward and rearward from his or her shoulders and head to grasp the barbell 124, such as shown. The backward tilted position is beneficial in that it allows the user to lay on the bench 112 without hitting his or head on the barbell 124 and without need to first lay on the bench and then slide or scoot upward to the barbell. In addition, the backward tilted position allows the barbell 124 to be stored in a stable position when not in use.

Figure 6B:
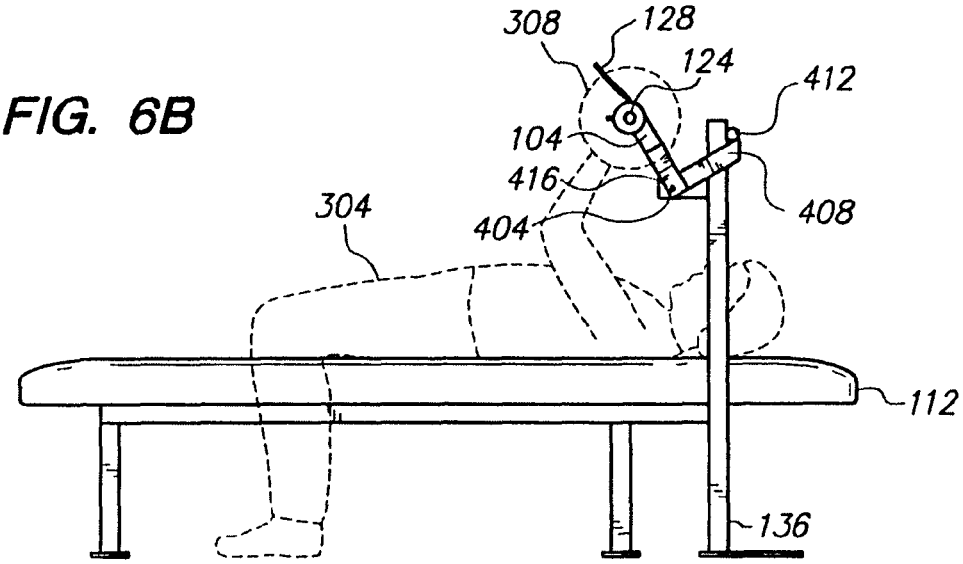
FIG. 6B is a side view illustrating operation of an exemplary rotating barbell support holding a barbell in a forward tilted position.
Figure 6C:
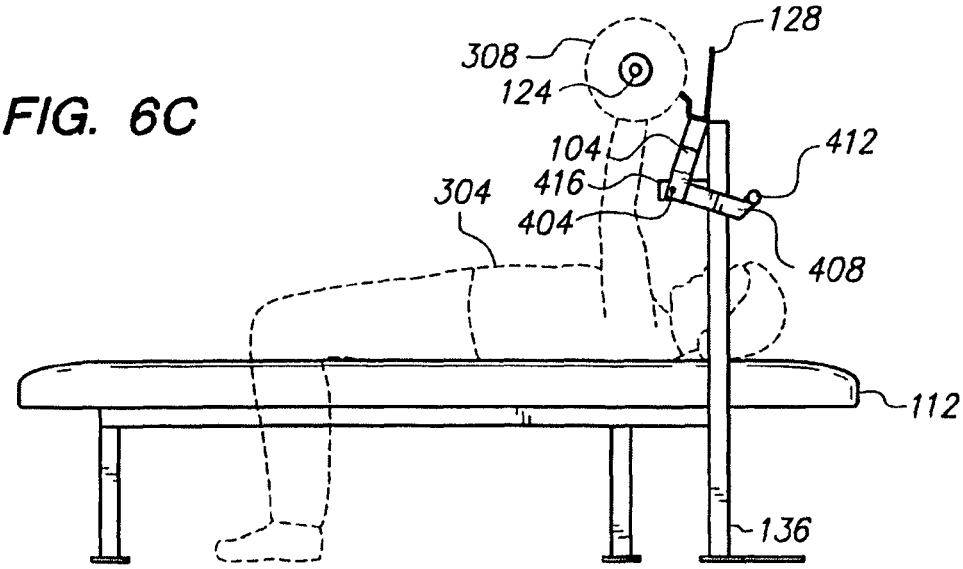
FIG. 6C is a side view illustrating operation of an exemplary rotating barbell support in a backward tilted position.

In FIG. 6B it can be seen that the user may pull the barbell 124 forward, thus rotating the weighted support assemblies forward to a forward tilted position. As discussed above, the forward tilted position may be defined by one or more stops, mating structures, or both. Once in this position, one or more bench presses may begin immediately without need for further horizontal positioning or movement of the barbell 124. This is one reason why the barbell 124 is considered to be in the user's sweet spot when the rotating barbell support is in a forward tilted position. To illustrate this, it can be seen from FIG. 6C that the user may lift upward to remove the barbell 124 from the upper supports 128 and, in the same motion, continue to perform a first bench press. The weight 412 of the weighted support assembly causes the weighted support assemblies to automatically return to a backward tilted position once the barbell is removed. The user may then place the barbell back into the upper supports 128 when he or she has finished a desired number of bench presses.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A rotating barbell support for supporting a barbell at a weight bench comprising:

a support frame having a front and a rear and comprising at least one front leg and one rear leg;

a first post extending upward vertically from a bottom end to a top end, proximate the rear of the support frame;

a second post extending upward vertically from a bottom end to a top end, proximate the rear of the support frame;

a horizontal axle having a first end and a second end, the horizontal axle being interposed between the first post and the second post, such that the first end of the horizontal axle is engaged with the bottom end of the first post, and the second end of the horizontal axle is engaged with the bottom end of the second post;

a first biasing member located at a location where the first end of the horizontal axle engages with the bottom end of the first post;

a second biasing member located at a location where the second end of the horizontal axle engages with the bottom end of the second post;

the first biasing member being configured to rotate about a horizontal axis, the first post having at least one barbell holder for supporting the barbell proximate the top end of the first post; and the second biasing member being configured to rotate about the horizontal axis, the second post having at least one barbell holder for supporting the barbell proximate the top end of the second post;

wherein when the barbell is removed from the rotating barbell support the first and second biasing members move the posts in a rearward direction from a tilted forward position to a tilted rearward position.

2. The rotating barbell support of claim 1 wherein the biasing members are springs.

3. The rotating barbell support of claim 2 wherein the springs are torsion springs.

4. The rotating barbell support of claim 2 wherein the springs are flat springs.

5. The rotating barbell support of claim 1 wherein the posts and horizontal axle are configured such that any movement of the posts is in unison.

* * * * *